US005937716A

United States Patent [19]

Klann

[11] Patent Number: 5,937,716

[45] **Date of Patent: *Aug. 17, 1999**

[54] TOOL FOR PREVENTING BOLTS FROM TURNING

[76] Inventor: Eugene C. Klann, 2900 County Rd. 6 SW., Stewartville, Minn. 55976

[ * ] Notice: This patent issued on a continued prosecution application filed under 37 CFR 1.53(d), and is subject to the twenty year patent term provisions of 35 U.S.C. 154(a)(2).

[21] Appl. No.: 08/779,374

[22] Filed: Jan. 7, 1997

Related U.S. Application Data

[63] Continuation of application No. 08/546,889, Oct. 23, 1995, abandoned.

[51] Int. Cl.[6] ..... B25B 7/02

[52] U.S. Cl. ..... 81/419; 81/487; 81/13

[58] Field of Search ..... 81/419, 487, 13, 81/55; 269/265, 268, 269

[56] References Cited

U.S. PATENT DOCUMENTS

| | | | |
|---|---|---|---|
| 64,904 | 5/1867 | Perry et al. | 81/13 |
| 80,998 | 8/1868 | Phelps | 81/13 |
| 206,954 | 8/1878 | Leete | 81/13 |
| 863,899 | 8/1907 | Bollwahn | 81/13 |
| 1,076,839 | 10/1913 | Peter | 81/419 |
| 1,346,306 | 7/1920 | Duket | 81/419 |
| 4,386,542 | 6/1983 | Verna | 81/424.5 |
| 4,776,079 | 10/1988 | Cameron | 81/419 |

FOREIGN PATENT DOCUMENTS

| | | | |
|---|---|---|---|
| 1220097 | 1/1960 | France | 81/13 |

*Primary Examiner*—David A. Scherbel
*Assistant Examiner*—Joni B. Danganan
*Attorney, Agent, or Firm*—M. Paul Hendrickson

[57] ABSTRACT

A tool is provided for preventing bolts from turning while the nut on the bolt is being loosened or tightened. The tool comprises opposed handle members each operatively connected to a jaw. The first jaw comprises a central longitudinally extending member designed to engage the head of a bolt when the tool is locked in place. The second jaw comprises a U-shaped member having two forked portions positioned on opposite sides of the plane of the first jaw member and being spaced apart sufficiently to receive the nut of a bolt therebetween when the tool is locked in place. Adjustable, releasable locking means are provided for locking the tool in place so as to prevent backout of the bolt while the nut on the bolt is being loosened or tightened.

7 Claims, 3 Drawing Sheets

TOOL FOR PREVENTING BOLTS FROM TURNING

This application is a continuation, of application Ser. No. 08/546,889, filed Oct. 23, 1995, now abandoned.

BACKGROUND OF THE INVENTION

The present invention is a tool for securing the head of a bolt in place while the nut on the bolt opposite the head is loosened or tightened.

It has long been well known to secure or attach two members by means of a bolt comprising a head, a threaded bolt shaft and a threaded nut operating on the shaft oppositely of the head. The shaft is placed through aligned holes in the two members and the nut is tightened to the point that the members (hereinafter the "work") are held securely together between the head and the nut. In many applications, the head extends outwardly of the work such that the head can be held against rotation by means of pliers, a wrench, or some similar tool while the nut is loosened or tightened.

In other applications, however, it is desirable that the head of the bolt be flush with the surface of the work. In such applications, the head is often shaped to be received and secured in a correspondingly shaped recess in the work and is thereby held against rotation while the nut is loosened or tightened. A common agricultural application for such bolts is in attaching a cultivator tooth (often referred to as "sweep") to a tine. This arrangement is satisfactory only so long as the head can be maintained in the recess. If the head is displaced from the recess due to longitudinal force applied to the bolt while the nut is loosened or tightened, the bolt will simply rotate with the rotation of the nut thereby frustrating loosening or tightening of the nut. Such "back-out" is most often a problem when the space between the head and the nut is sufficient to permit the head to be fully withdrawn from the recess.

In some instances, this limitation can be overcome simply by the user applying manual pressure against the head while the nut is being turned. In many instances, however, the simultaneous application of manual pressure against back-out is impossible, inconvenient or inadequate. For instance, in many situations where the nut may have rusted on the bolt shaft, the user often needs both hands in order to loosen the nut, and it is difficult to prevent backout.

It is one object of the present invention to prevent backout of the head of a bolt while the nut is loosened or tightened.

It is another object of the present invention to provide a tool for preventing backout of a bolt while being loosened or tightened which is lockable on the work to free both hands of the user.

To those ends, the tool comprises opposed handle members joined at a pivot, each of the handle members having a jaw member attached oppositely of the pivot such that as the handle members are moved more closely together (or closed), the jaw members will also close. The tool is lockable by virtue of an adjustable locking mechanism generally similar to the mechanism on lockable pliers sold under the trade name "Visegrip" whereby the tool may be adjusted to lock on differently sized work.

The first jaw member comprises a single, centrally positioned member which bears against the head of the bolt when the tool is in place. The second jaw member is generally U-shaped and comprises a pair of spaced members that are offset sidewardly with respect to the centerline of the tool for gripping the work oppositely of the first jaw member. When the tool is in place, the first jaw member acts against the head of the bolt to prevent backout, and the second jaw members are spaced from the nut to allow access to the nut for turning.

DETAILED DESCRIPTION OF THE PREFERRED EMBODIMENT

Figure 1:
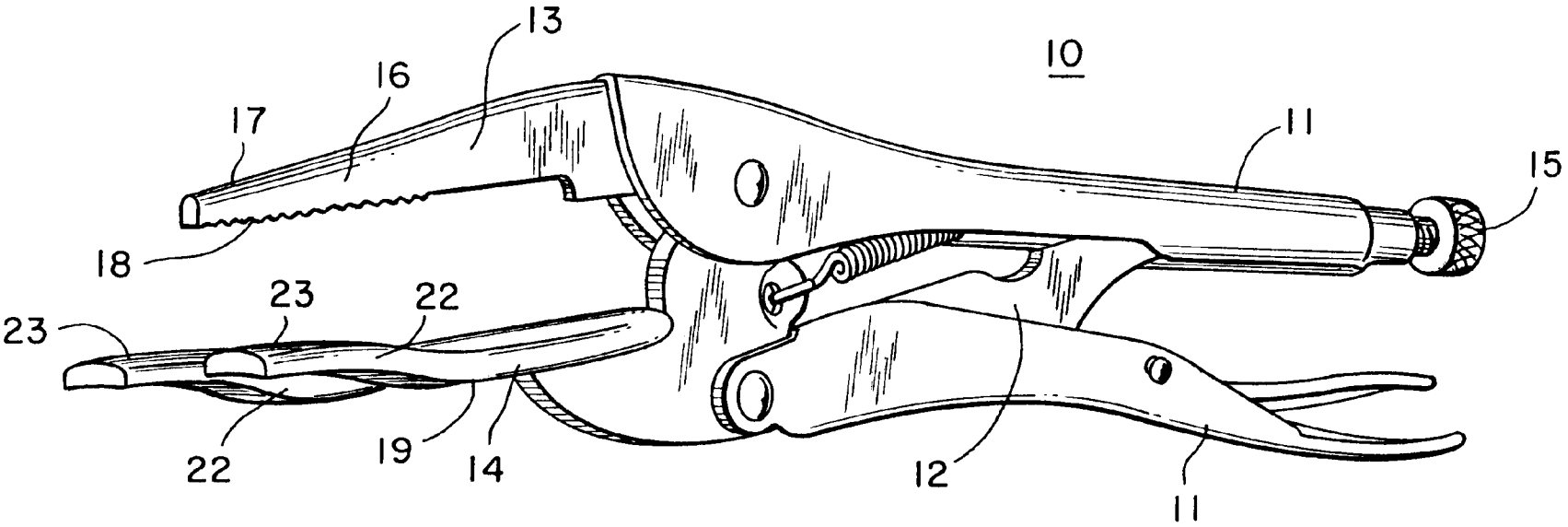
FIG. 1 is a side elevational view of a tool according to the present invention.

Referring to the drawing, wherein like numerals represent like elements throughout the several views, there is provided a tool for preventing bolts from turning, generally designated by the numeral 10. The tool 10 comprises a pair of handle members 11, pivoted to a conventional locking mechanism 12, a first jaw 13 and a second jaw 14 attached to the locking mechanism 12 oppositely of the handle members 11. The locking mechanism 12 is preferably a conventional mechanism commonly used in lockable pliers sold under the trade name "Visegrip" and described in U.S. Pat. No. 2,280,005. The locking mechanism 12 also includes an adjustment screw 15 which can be used in the conventional manner to adjust the tool 10 to lockably engage work of different dimensions.

First jaw 13 comprises a single, longitudinally extending member 16 positioned along the centerline of the tool 10, the top surface 17 of which tapers toward its exterior end such that it resembles one of the jaws of a conventional needle nose pliers. The bottom surface 18 of member 16 is generally flat and scored to provide enhanced frictional engagement with the head of a bolt when the tool 10 is locked in place.

Second jaw 14 comprises a U-shaped member 19 having a central, rear yoke portion 20 and two forwardly extending forked portions 21 spaced from and extending parallel to one another. The ends of the forked portions 21 are bent inwardly through shoulder portion 22 to define an inwardly offset work engaging outer end 23. Outer ends 23 are positioned at such an angle that they will be substantially parallel to the bottom surface 18 of first jaw 16 when the tool 10 is locked in place. Forked portions 21 are substantially equal in length to first jaw 16. The spacing between forked portions 21 is sufficient to allow the user easy access to the nut for rotation with respect to the bolt, typically on the order of 1 ½ to 3 inches.

Second jaw 14 may be strengthened by forming a rib 24 therein. In addition, the inner surfaces of outer ends 23 may be scored to facilitate gripping of the work.

Figure 2:
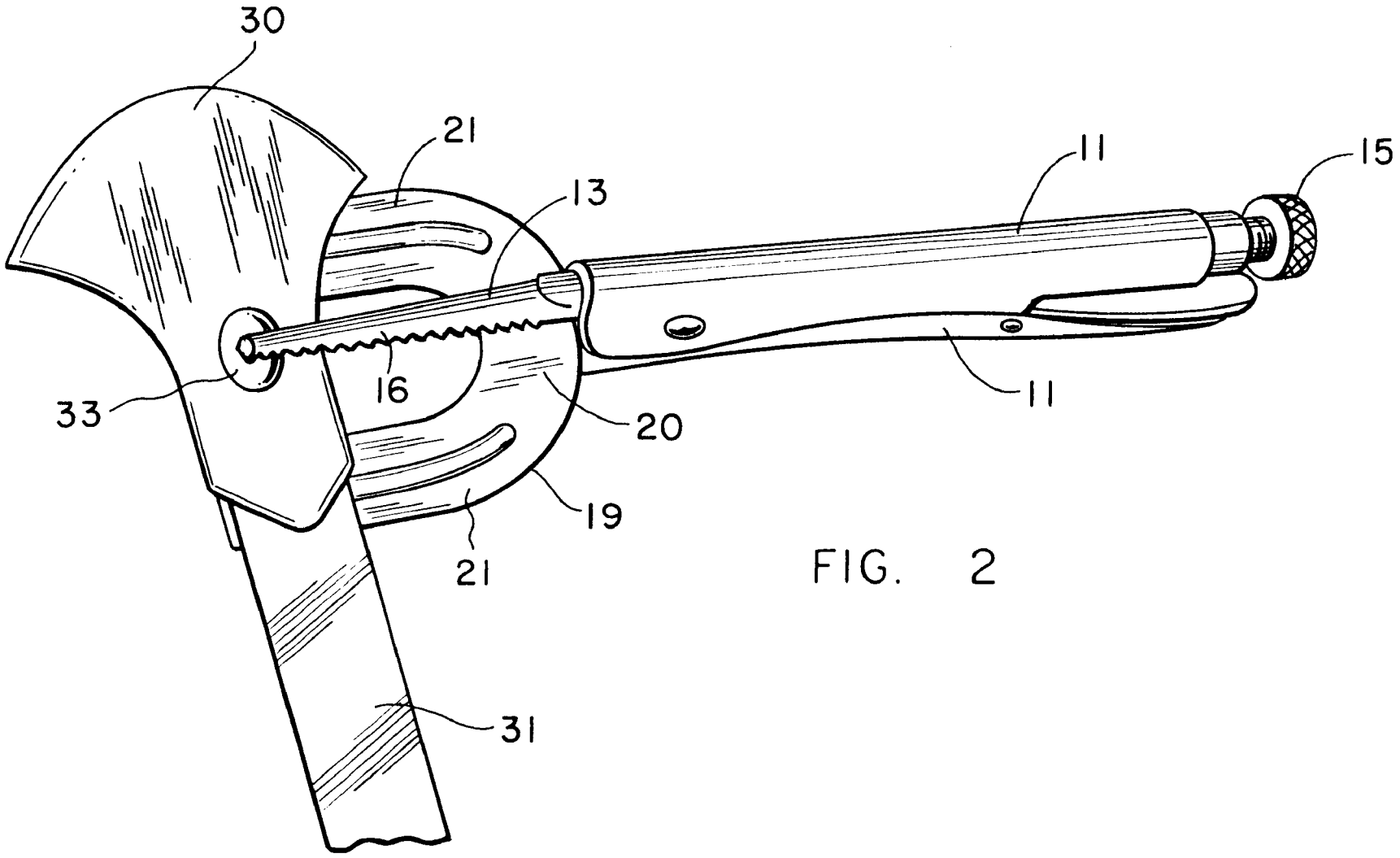
FIG. 2 is a top elevational view of a tool according to the present invention showing the tool locked in place on the work, in this case, a worn field cultivator sweep attached to a cultivator tine.
Figure 3:
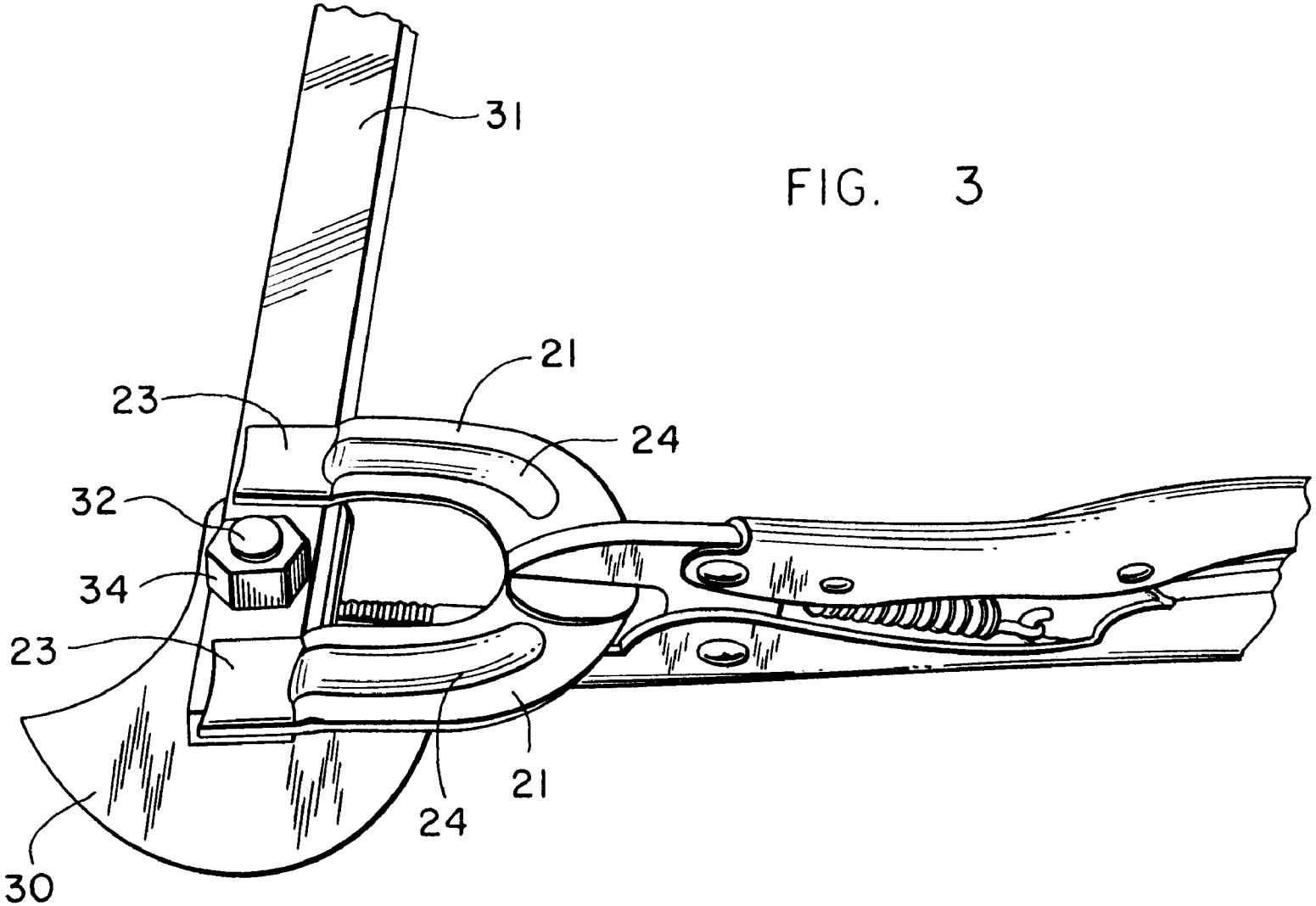
FIG. 3 is a bottom elevational view of a tool according to the present invention showing the tool locked in place on the work, in this case, a worn field cultivator sweep attached to a cultivator tine.

The utility of the tool 10 is best illustrated with reference to FIGS. 2 and 3 which show the tool 10 locked in place on the work from opposite views. As shown, the work consists of a worn cultivator sweep 30 bolted to a cultivator tine 31 by means of a plow bolt 32 with a head 33 and nut 34 operating on the bolt 32 opposite the head 33. To lock the tool 10 in place, adjustment screw 15 is rotated until the jaws 13 and 14 maintain the desired spacing when the tool 10 is locked. The tool 10 is then positioned on the work in such a fashion that the outer portion of the bottom surface 18 of first jaw 16 is positioned over the head 33 of bolt 32 and the nut 34 is positioned between forked portions 21 of second jaw 19. Once in this position, the tool 10 can be locked in place by closing the handle members 11 in the normal fashion.

While the preferred embodiment of my invention has been described, it will be apparent that other embodiments are possible within the scope of my invention.

What is claimed is:

1. A method for removing a nut from a flat-headed plow bolt having a flat surfaced head and a shouldered section positioned beneath the head which shouldered section seats against a corresponding and mating seat coutersunken within a work while preventing rotational turning of the bolt said method being conducted with a tool equipped with a pair of handle members; a rigid first jaw operatively connected to one of said handle members, said first jaw consisting essentially of a single, longitudinally positioned member having a rigid inner jaw surface for engaging and maintaining the head flushly onto the surface of the work; an adjustable second jaw operatively connected to the other of said handle members, said second jaw comprising two forked portions positioned on opposite sides of the plane of said first jaw and being spaced apart sufficiently to permit removal of the nut from the bolt; and releasable locking means for locking the inner jaw surface of said second jaw against the head at a predetermined distance from said first jaw so as to maintain the head flushly against the surface of the work while removing the nut from the bolt, said method comprising:

a) positioning the inner surface of the longitudinally positioned member onto the head while straddling the nut between the forked portions of the second jaw;

b) drawing the first jaw against the head and the second jaw towards the head and against the work so as to cause a firm seating of the shouldered section onto the seat of the work;

c) locking the inner surface of the first jaw firmly against the head at the predetermined distance from said second jaw so as to maintain the forked portions flushly against the surface of the work and the shouldered section firmly seated within the seat;

d) removing the nut from the bolt while concurrently maintaining the head flushly against the work with said inner jaw surface and the inner surface of the second jaw firmly against the work;

e) releasing the locking means to release the jaw and the forked portions of the second jaw from the work; and f) separating the bolt from the work.

2. The method according to claim 1 wherein the removing of the nut comprises unthreading the nut from bolt by wrenching the nut.

3. The method according to claim 2 wherein the work comprises a cultivator sweep and the method includes the removing of the nut from the bolt while maintaining the head flushy against the cultivator sweep, the releasing of the locking means and the separating of the bolt from the cultivator sweep.

4. The method according to claim 3 wherein the locking means of the tool includes an adjusting screw for adjustably drawing the second jaw towards the first jaw so as to permit locking at the predetermined distance and the method includes adjusting the adjusting screw so as to permit the locking of the first jaw and the second jaw at the predetermined distance.

5. A method for removing a rusted nut from a plan bolt equipped with a flat surfaced head flushy countersunken into a countersunken seat of a work and a shouldered section countersunkenly seated onto the seat of the work while preventing rotational turning of the bolt with a tool of a locking pliers type equipped with a first handle and a second handle; a stationary first jaw rigidly connected to said first handle, said first jaw consisting essentially of a single, longitudinally positioned member having a rigid inner jaw surface for rigidly engaging against the smooth surfaced head and maintaining the shouldered section seated within the seat; a second jaw operatively connected to said second handle and pivotally mounted to said first handle, slid second jaw comprising forked portions positioned on opposite sides of the plane of said first jaw for securely engaging against the work and being spaced apart sufficiently to permit removal of the nut from the bolt; and adjustable and releasable locking means for locking said second jaw securely against the work at a predetermined distance from said first jaw so as to countersunkenly maintain the shouldered section flushly and rigidly against the seat of the work with said inner surface while removing the nut from the bolt and a for releasing means for releasing the locking means from the work, said method comprising:

a) adjusting the locking means to the predetermined distance for locking the inner jaw surface of said first jaw from said second jaw so as to countersunkenly maintain the shouldered section flushly and rigidly against the seat of a work;

b) positioning the inner surface of the longitudinally positioned member onto the head while straddling the nut between the forked portions of the second jaw;

c) drawing the first jaw and second jaw together;

d) locking the second jaw at the predetermined distance from said first jaw with said locking means so as to rigidly maintain the shouldered section flushly and rigidly seated onto the scat of the work with said inner jaw surface and the second jaw rigidly against the work;

e) removing the nut from the bolt while maintaining the section flushly and rigidly seated within the seat of the work;

f) releasing the locking means with said releasing means to concurrently release the first jaw and the second jaw from the work; and g) separating the bolt from the work.

6. The method according to claim 5 wherein the work comprises a cultivator sweep and the method includes the removing of the nut and unthreading the nut from bolt by wrenching the nut while maintaining the first jaw rigidly against the head and the second jaw rigidly against the sweep.

7. The method according to claim 6 wherein the locking means of the tool includes an adjustable screw for adjustably drawing the first jaw towards the second jaw so as to permit locking at the predetermined distance and the method includes adjusting the adjusting screw before locking the first jaw at the predetermined distance against the head.

* * * * *